United States Patent [19]

Priese et al.

[11] 4,124,147

[45] Nov. 7, 1978

[54] FLEXIBLE DIAPHRAGM DISPENSING SYSTEM FOR CONDIMENTS

[75] Inventors: Werner K. Priese, Barrington; Jerry C. Janquart, Crystal Lake; Deryl B. Stanley, Elgin, all of Ill.

[73] Assignee: Hills-McCanna Company, Carpentersville, Ill.

[21] Appl. No.: 774,268

[22] Filed: Mar. 4, 1977

[51] Int. Cl.[2] ..... G01F 11/08; B67D 5/52

[52] U.S. Cl. ..... 222/135; 222/263; 222/288; 222/380; 251/61.1

[58] Field of Search ..... 251/61.1, 331; 222/207, 222/212, 214, 380, 334, 442, 372, 144.5, 135, 263, 288

[56] References Cited

U.S. PATENT DOCUMENTS

| | | | |
|---|---|---|---|
| 2,529,028 | 11/1950 | Landon | 251/61.1 X |
| 3,083,943 | 4/1963 | Stewart, Jr. et al. | 251/61.1 |
| 3,180,527 | 4/1965 | Wasilewski et al. | 222/334 X |
| 3,203,595 | 8/1965 | Berkowitz | 222/144.5 X |
| 3,727,804 | 4/1973 | Smith et al. | 222/372 X |
| 4,032,044 | 6/1977 | Flynn et al. | 222/380 X |

*Primary Examiner*—David A. Scherbel
*Attorney, Agent, or Firm*—Olson, Trexler, Wolters, Bushnell & Fosse, Ltd.

[57] ABSTRACT

There is disclosed a novel dispensing unit and system for the controlled, metered dispensing of one or more liquid products. The unit which serves to provide an important part of the system is designed for use with an arrangement wherein pressurized liquid products are delivered to the unit for controlled, metered dispensing. The unit is characterized primarily by the employment of metering chambers defined partially by flexible diaphragms. In conjunction with each said chamber, there are provided an inlet and outlet passage arrangement and a valve arrangement for controlling the supply and discharge of liquid product from said metering chamber. The unit includes a selectively operable control arrangement provided for opening and closing the valving arrangement, and also alternately pressurizing and venting the metering chamber diaphram with respect to a pressurized medium. When pressurized the metering chamber diaphragm will move relative to the remainder of the metering chamber to expel a predetermined quantity of liquid product from said chamber. The liquid product thus expelled will correspondingly replace liquid product in the discharge passage of the unit and will ultimately result in dispensing of a similar quantity of product from the dispensing head or outlet ports for the unit.

23 Claims, 10 Drawing Figures

FLEXIBLE DIAPHRAGM DISPENSING SYSTEM FOR CONDIMENTS

BACKGROUND OF THE INVENTION

The present invention pertains to a dispensing unit and system for liquid products, and more particularly to a system and unit wherein a plurality of different liquid products, such as condiments may be dispensed with controlled proportioning thereof.

One of the fastest growing industries, both here in the United States and in foreign countries, is that of the fast food franchise. Rising costs have necessitated employment of labor and time-saving devices to perform the various operations required in the preparation of the final, consumable product. One such operation which has proved to be both time-consuming and unreliable, is the controlled dispensing of condiments such as catsup, mustard, or the like, as used on hamburgers and other types of sandwiches. In this regard, the restauranteur is concerned not only with the labor involved, but also with the obtaining of uniformity in the amount of condiment dispensed, so as to maintain flavor standards and minimize waste.

In a related application, Ser. No. 664,556, now U.S. Pat. No. 4,032,044 there is disclosed a basic concept or system, including dispensing units, for the metered dispensing of liquid products, wherein a metering chamber is provided, and partially defined by a flexible wall or diaphragm. Through a control system different from that of the present invention, the force or pressure differential across this diaphragm is used to force said diaphragm into engagement with the opposite chamber wall, thus expelling a predetermined volume of condiment from the metering chamber.

The basic concept as disclosed and claimed in said application has wide application, and covers the present invention, which is in effect an improvement thereover. The particular dispensing units as shown in said application, utilize mechanical valving actions for controlling the flow of the liquid product to and from the metering chambers, which have proved troublesome in certain applications. More specifically, the term "mechanical valving" is used in a sense to connote valve arrangements of the type wherein one element, such as a valve spool, or a disc, is moved relative to an outer, ported element alternately to block and establish flow through said outer element. This type of a valve arrangement requires clearance between the relatively movable part as well as the use of seals to prevent leakage. While the mechanical type of valving action are totally adequate for liquid products which do not include a large percentage of suspended solids, when slurries or suspensions having high solid content are encountered such as mustard, these solids can penetrate the areas between the relatively movable parts tending to produce wear and clog or otherwise hinder the valving action.

As a further matter, when the liquid product to be dispensed is a food condiment, rigid sanitary and cleaning procedure must be adhered to. In this regard, it can be appreciated, that standard mechanical type valving actions do not lend themselves to ease of disassembly, cleaning and reassembly. The present invention, as will become clear from the discussion to follow, provides a convenient alternative to this problem.

With the dispensing unit of the present invention the expelling of the pressurized product from the metering chamber is achieved pursuant to the attainment of a pressure or force differential across the metering chamber diaphragm, which differential is produced by the alternate pressurization or venting of the side of the diaphragm opposite said chamber with respect to a pressurized medium such as nitrogen gas. As a further matter, the present invention also employs valve means for the control of the flow of the liquid product, which valve means are not subject to the numerous disadvantages of the mechanical type of valving as discussed above. More specifically, the valving action as contemplated by the present invention will be provided by a valve chamber defined partially by a cavity or concave wall surface having a weir extending thereacross, with a flexible diaphragm overlying said cavity and weir to define in effect a valve chamber. Valve inlet and outlet port communicate with the chamber on opposite sides of the weir, and means are provided for pressurizing the side of the diaphragm opposite the weir, to force the diaphragm into engagement with the weir and thereby block communication between the inlet and outlet ports.

As will become clear from the discussion to follow a separate diaphragm valve can be used to control the supply and discharge of the product from the metering chamber. The present invention, however, employs an ingenious arrangement whereby a single chamber functions both as the metering chamber and the valve means for controlling the supply of liquid product.

As an additional matter, it can be appreciated that in the unit as discussed above pressurization of the metering chamber and valve chamber diaphragms can be attained by using a pressure medium at a pressure level higher than that of the liquid product being supplied to the dispensing unit. The system of the present invention, however, provides a system whereby the operation of said diaphragms can be attained even through the pressurized medium and the liquid product are at substantially the same pressure. This arrangement, of course, greatly simplifies the overall system.

More specifically, with the present invention, even though the pressurized medium and the liquid product are at substantially the same pressure, the diaphragm type of valves will close quickly. This occurs, due to the fact that the pressure applied to the side of the diaphragm opposite the chamber is in effect a static or constant pressure which acts upon the full surface area of the diaphragm. On the other hand, the movement or flow of the liquid product through the respective chamber results in a pressure drop which is sufficient to create the differential that will commence movement of the diaphragm toward the chamber weir. As the diaphragm moves, increased throttling of the liquid product occurs which, in turn, results in an even greater pressure differential. Once the diaphragm is brought into engagement with the weir, the area on one side of the weir will be exposed to liquid product under pressure, while the area on the opposite side of the weir is subject only to ambient pressure. Thus, the force on the side of the diaphragm exposed to the pressurized medium will be greater than that created by the portion of the diaphragm exposed to the pressurized product and engagement of the diaphragm with the weir will be maintained.

DESCRIPTION OF THE ILLUSTRATIVE EMBODIMENTS

Figure 1:
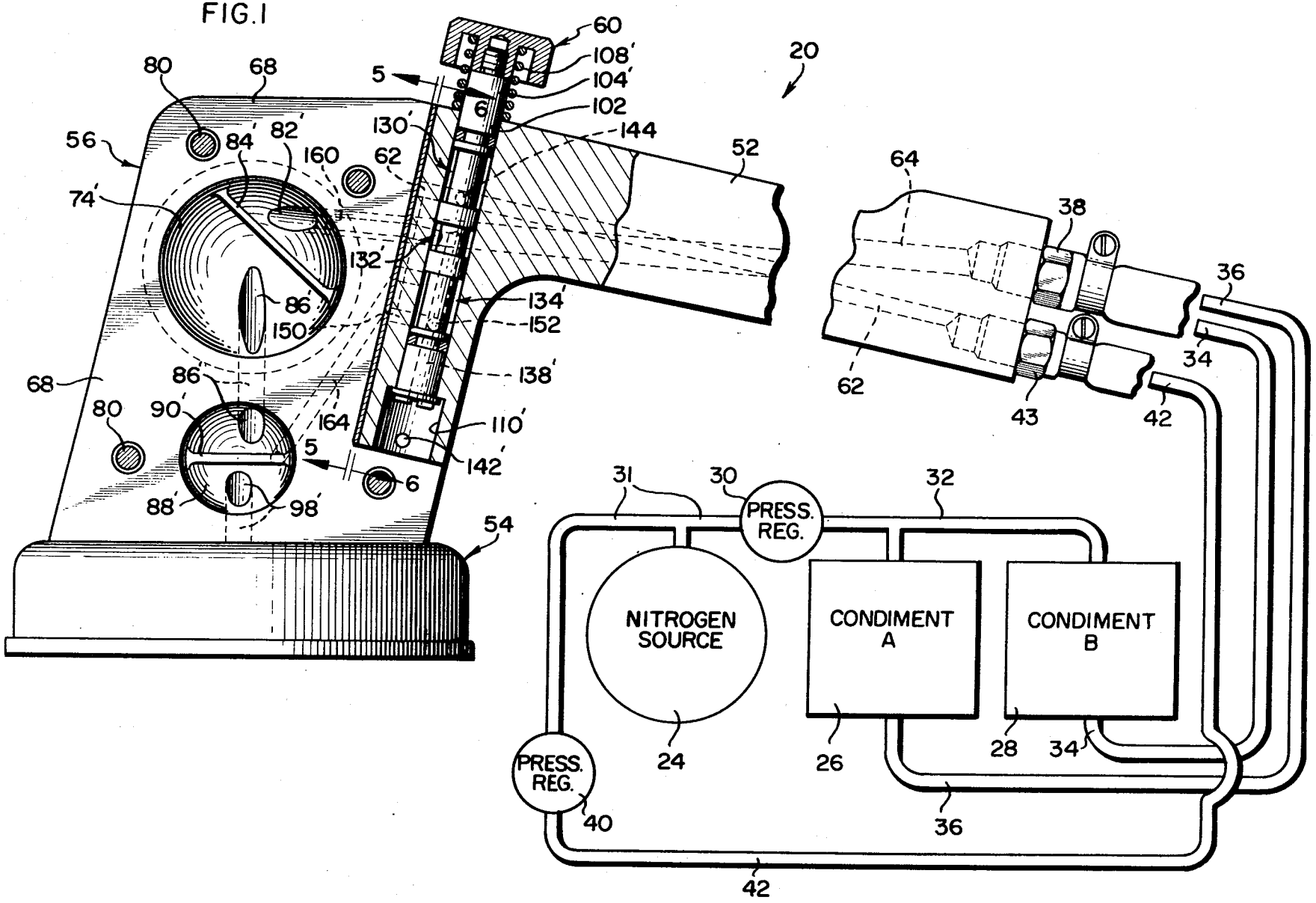
FIG. 1 is a schematic representation of a dispensing system according to the present invention; a portion of the dispensing unit has been broken away to expose the valving mechanism for controlling the supply of the pressurized medium, also an outer plate element of the main body assembly has been removed to expose to view the concavities which will define the metering and valve chambers.

Attention is now directed to the drawings, and initially to FIG. 1 thereof. In FIG. 1 there is disclosed a basic overall system, designated generally 20, for the dispensing of separate liquid products such as condiments A and B from a dispensing unit 22. It should be kept in mind that the drawings are illustrative of a particular system 20 and unit 22 adapted for the dispensing of condiment products, and that the basic concepts involved can be used in the design of alternate systems or units for other products and/or applications.

Turning now to the system 20, as illustrated, this system includes a dispensing unit 22, a source of pressurized medium such as nitrogen gas 24, supply vessels 26 and 28 for the condiment products A and B which vessels are designed to store said products under pressure, and suitable supply lines for the pressurized medium and the liquid products.

More specifically, the liquid product in the vessels 26 and 28 are stored under pressure provided from the source of pressurized medium 24. In this regard the pressurized medium is supplied to vessels 26 and 28 by way of the pressure regulator 30 and supply lines 31, 32 and 33. The liquid products in vessels 26 and 28 are in turn placed in communication with the dispensing unit 22 by means of the supply lines 34 and 36 which are attached to said unit 22 by appropriate fittings 38. The source of pressurized medium 24 is also connected directly to the dispensing unit 22 by way of supply lines 31, pressure regulator 40 and supply line 42 which communicated with unit by way of a fitting 43.

While the detailed discussion of the construction and operation of the dispensing unit 22 will follow hereafter, the general operation of said unit 22 with respect to the overall system 20 will first be considered. More specifically, the dispensing unit 22 is provided with a pair of metering chambers, designated generally 44 and 44', and best viewed in FIGS. 2 and 3. Pressurized product A is supplied to the metering chamber 44, while product B is supplied to chamber 44'. The respective metering chambers 44 and 44' and the supply lines leading thereto are distinct so that no co-mingling of the product takes place.

Figure 2:
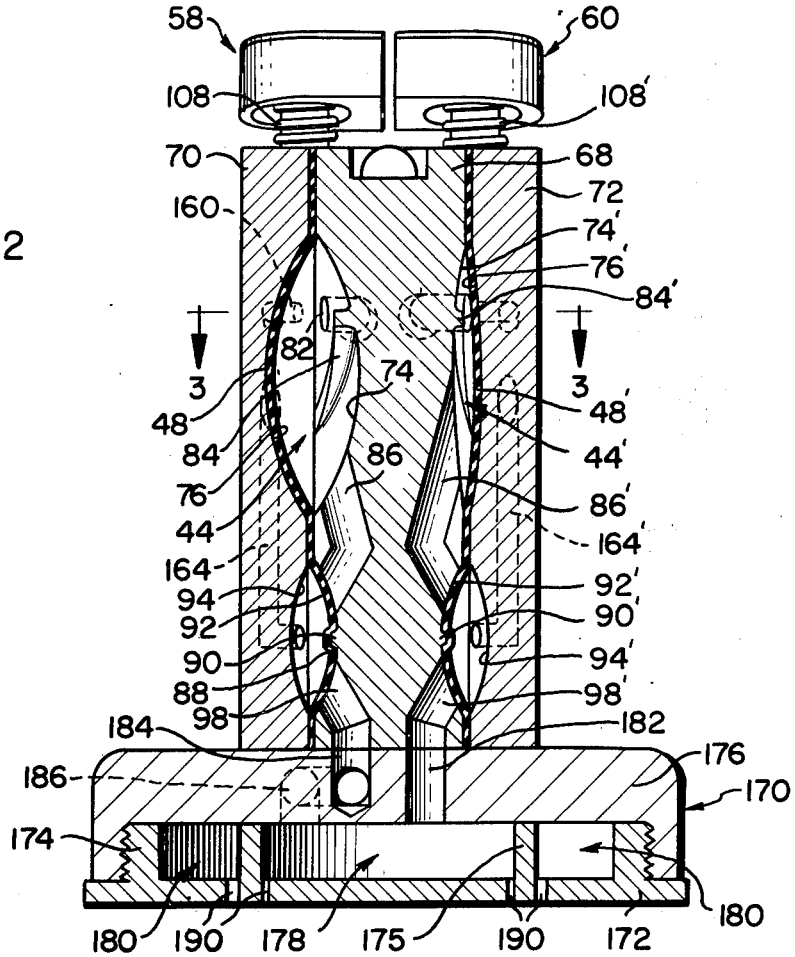
FIG. 2 is a vertical sectional view taken through an assembled dispensing unit and illustrating the condition of the metering chamber and the valve chamber diaphragm prior to dispensing.
Figure 3:
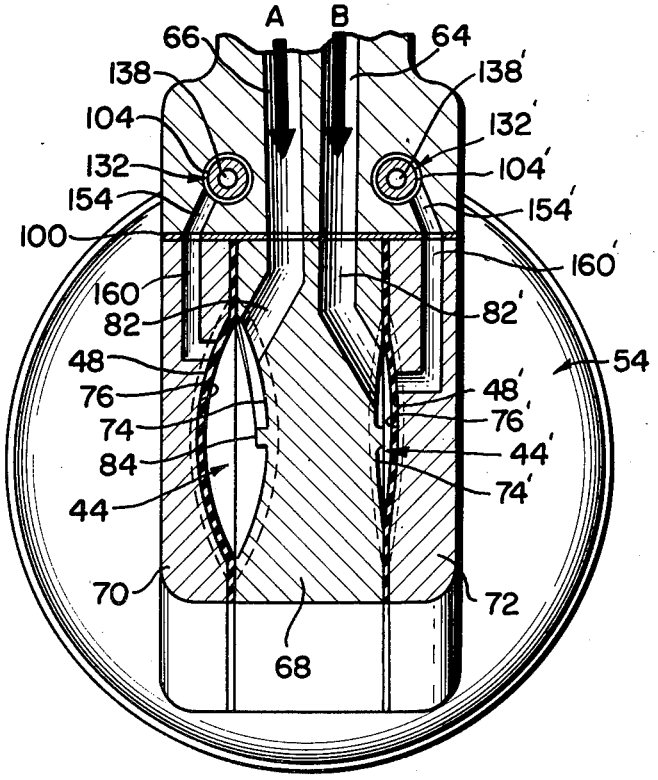
FIG. 3 is a horizontal, section view taken through the dispensing head of FIG. 2 along the line 3—3.
Figure 9:
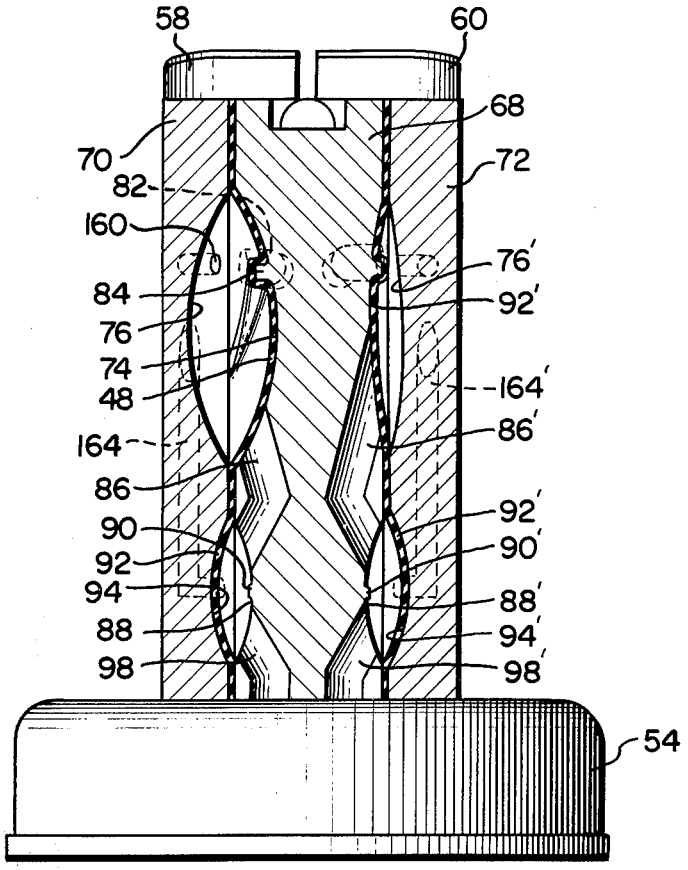
FIG. 9 is a vertical sectional view similar to FIG. 2 but illustrating the condition of the metering head upon depressing of the valve spindle to the condition as shown in FIG. 8.

The chambers 44 and 44' are defined partially by flexible diaphragm elements 48 and 48', which as will become clear from the discussion to follow, are movable with regard to the stationary wall surfaces of said chambers under the influence of the pressurized medium from source 24. In the normal or pre-dispensing condition the diaphragms 48 and 48' will not be pressurized and the liquid products A and B will fill the metering chambers 44 and 44', biasing the diaphragms 48 and 48' to the expanded condition as seen in FIGS. 2 and 3. When it is desired to dispense product A, product B or both, the control means also to be detailed hereinafter, is operated to pressurize said diaphragms 48 and 48' to produce a force differential across said diaphragms effective to move said diaphragm into engagement with the opposing wall surfaces of the metering chambers, as shown in FIG. 9. This movement of the diaphragms will force a volume of product from the respective metering chambers 44 and 44'. Furthermore, it will be noted that during the normal or pre-dispensing condition as shown in FIGS. 2 and 3 and the dispensing condition as shown in FIG. 9, effective control of the flow of the pressurized liquid product must be attained. The structural feature of the present invention which enables attainment of this control as well as those providing the respective valve chambers 44 and 44' will now be considered.

With a general understanding of the operation of the overall system 20 and dispensing unit 22 in mind, attention is now directed to the construction of a preferred form of dispensing unit 22, with initial consideration being directed to FIG. 1. Basically, the dispensing unit 22 includes a handle segment 52, a dispensing head 54, a metering head or main body assembly 56, and control means 58 and 60 in the form of spool type valves carried by the handle 52.

Handle portion 52 is of an elongate construction and has a series of passages provided therein which communicate with the fittings 38 and 43 and are illustrated in a dotted outline in FIG. 1. More specifically, a passage 62 is connected to the supply line 42 for the pressurized medium, by way of the fitting 43 and provides for the supply of said pressurized medium to the valve means 58 and 60. A pair of supply passages 64 and 66 are provided for the liquid products (condiments A and B) and while only the passage 64 can be viewed in FIG. 1, both of such passages can be seen in FIG. 3.

The main body or metering head assembly 56 includes a central body portion 68 having opposed planar sides to which are affixed a pair of side portions 70 and 72. One side of the main body portion 68 is provided with a pair of depressions or cavities 74 and 76, and preferably, but not of necessity, corresponding cavities 76 and 78 are formed in the facing surface of the side portion 70 which overlies and mates with the main body cavities 74 and 76. Correspondingly, the opposite side of the main body portion 68 includes cavities 74' and 76', while side portion 72 includes cavities 76' and 78'. The diaphragm means 48 and 48', mentioned previously, are positioned intermediate the juxtaposed surfaces of the main body portion 68 and the side portions 70 and 72 as illustrated in FIG. 3. It should be noted, that in FIG. 1, the side body portion and the diaphragm means have been removed to expose to full view the cavities 74' and 76' formed in the main body portion 68. The diaphragm members 48 and 48' cooperate with the wall surfaces of the respective cavities 74 and 74' to define the metering chambers 44 and 44'.

The side body portions 70 and 72 serve to limit the outward movement or expansion of the diaphragms 48 and 48' when the liquid product under pressure is introduced into the metering cavities 44 and 44'. It can be appreciated further that the volume of the resulting metering cavities and correspondingly the volume of the condiment to be dispensed are determined to a great extend, by the volume of the opposed cavities 74 and 74'. The side portions 70 and 72 are affixed to the main body portion 68 by a plurality of releasable fastener elements 80 (viewable in FIG. 1) so that said side portions can be easily removed. Thus, by the provision of interchangeable side portions, with cavities 74 and 74' of varying volume, the volume of liquid product dispensed can easily be adjusted to suit a user's needs. As an initial matter, and as can be viewed in FIG. 1, removal of said side portions 70 and 72 also provides access to the metering chambers 44 and 44' for cleaning of the unit 22.

Consideration will now be directed to the specific structure of the unit 22 which provides for the supply of liquid product to the metering chambers 44 and 44' and that which controls the flow of said product and the metering operation. In this regard, the structural features and elements associated with the metering cavity 44' for condiment B, are essentially the same as those employed for chamber 44 for condiment A. Accordingly, for purposes of simplicity and clarification, the detailed discussion which is to follow and which will include reference characters, will be directed only with regard to the structural features and elements associated with the metering chamber 44. The corresponding structural elements and features which are associated with the opposite chamber 44' will be given identical reference characters, but with a primed (') designation for purposes of a final discussion as to the overall operation of the unit 20.

Consideration will now be directed to the passage means which provides for the flow of the pressurized liquid product to the main body assembly 56 and from there to the dispensing head 54. The features of the dispensing head 54 which enables the respective condiments A and B to be dispensed separately will be discussed hereinafter with regard to FIGS. 2 and 10. In addition, the path for delivery of the pressurized medium to the various diaphragms, as well as the structure and operation of the control means 58 and 60 for the control of the application of said pressurized medium will also be detailed hereinafter.

With reference to FIG. 3, the passages 64 and 66 in the handle 52 for the liquid products A and B can be seen, with passage 66 handling condiment A to be supplied to the metering chamber 44 and passage 64 supplying the condiment B for chamber 44'. The handle 52 is attached to the main body member 68 by suitable fastener means (not shown) and a port or passage 82 is provided in said main body member 68, which port 82 aligns with passage 66 and opens into cavity 74. As can be seen in FIGS. 2 and 3, the wall surface which defines the cavity 74 includes an elongate ridge or weir 84 for purposes to be detailed more specifically hereinafter, with the port 82 opening into said cavity on one side of said weir 84. The main body portion 68 includes a second passageway 86 (best seen in FIG. 2) communicating with the metering cavity 74 on an opposite side of the weir 84 and providing outlet passage means for said metering chamber 44.

In addition to the cavity 74, the main body 68 also includes a second cavity 88. The relationship of this second cavity 88 with respect to the metering cavity 74 can best be understood with reference to FIG. 1, wherein the corresponding cavity 74' and 88' are shown in plan view. The cavity 88 includes a weir 90, and a diaphragm section 92 overlies the cavity 88. As was the case with the metering cavity 44, the side body portion 70 may include a mating cavity 94 which in effect mates with the cavity 88 to define a stop or limit for expansion of the diaphragm 92 outwardly of the cavity 88. The diaphragm 92 and the cavity 88 cooperate to define opposed wall surfaces of a valve chamber, designated generally 96. It should be noted that while the metering chamber diaphragm and the valve chamber 92 have been given separate reference designations, they are provided by a single element clamped between the main body section 68 and the side portions 70. If desired, of course, separate diagram elements could be utilized.

Looking to FIG. 2, it can be seen that the outlet passage 86 for metering chamber 44 opens through the wall of the cavity 88 on one side of the weir 90. A discharge or dispensing port 98 is provided in the main body portion 68 and communicates with the valve chamber 96 on the opposite side of the weir 90. The discharge port 90 opens through a bottom surface of the main body 68 and is in operative communication with the dispensing unit 54.

The path for the pressurized medium through the handle 52, to the control means 58 and 60, and into the metering body assembly 56 will now be considered. In this regard, the discussion will initially cover the basic construction of the valve arrangement in conjunction with the flow paths for the pressurized medium to the valve means; secondly, the paths for the pressurized medium from the control means 58 and 60 to the sides of the respective diaphragms 48 and 92, opposite the metering chamber 44 and valve chamber 96, respectively; thirdly, the general overall operation of the dispensing unit will be considered.

In FIG. 1, it can be seen that the control means 58 and 60 are positioned adjacent the interface of handle 52 with the metering body assembly 56, with a gasket member 100 provided to seal against any leakage at said interface. It should be recalled that control means 58 controls the operation with regard to metering chamber 44 while control means 60 control the operation of the metering chamber 44'. Here again, discussion will be directed primarily to the operation of the unit 22 with regard to chamber 44, as this chamber is the larger of the two chambers. Accordingly, it must be kept in mind that in FIG. 1, the valve means illustrated is the assembly 60 for the metering chamber 44 and as such the reference character in FIG. 1 include a prime designation.

Figure 4:
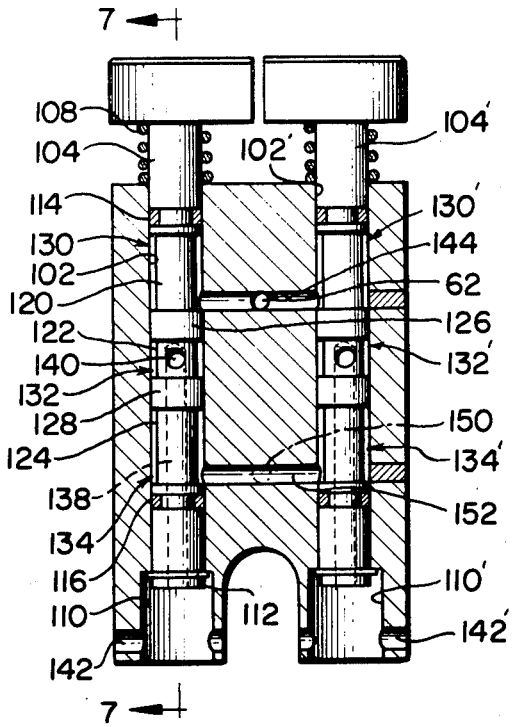
FIG. 4 is a sectional view taken through the dispensing unit and illustrating the condition of the control valves for the pressurized medium in thenormal or predispensind condition.

Directing attention to FIG. 4, the control means 58 provided in the handle 52 can be viewed. Said control means 58 includes an elongate valve bore 102 in which is disposed a valve spool or plunger 104. The valve spool 104 has an upper, enlarged portion 106, and is biased to a normal or pre-dispensing position by a spring member 108. The lower portion of the valve bore 102 is enlarged at 110 to provide a shoulder, and a snap ring 112 is carried by valve spool 104, which will engage said shoulder and limit movement of the spool 104 axially of the bore 102.

Valve spool 104 has upper and lower sealing assembly 114 and 116 carried thereon, which engage the valve bore 102 to preclude escape of the pressurized medium along the bore walls. Intermediate the sealing elements 114 and 116 there are provided elongate, reduced diameter segments 120, 122 and 124, separated each from the other by land portions 126 and 128 which slidably engage the surface of valve bore 102. The land portion 126 and 128 in conjunction with seal assemblies 114 and 116, and the reduced diameter segments 120, 122 and 124 cooperate to define three separate and distinct valve chambers 130, 132 and 134. As can be appreciated, upon depression of the valve spool, the chambers 130, 132 and 134 will move axially relative to the bore.

In addition to the above discussed valve chambers, the valve spool also includes a central, axial passageway 138 shown in dotted outline in FIG. 4. The passageway 138 opens to the bottom end surface of the spool and terminates proximate the reduced diameter section 122 which defines a valve chamber 132. A transverse or radial port 140 is formed in the reduced diameter section 122 and intersects the axial passageway 138 to provide communication from the valve chamber 132 to said axial passageway 132.

As an additional matter, it is to be noted that in the area of the enlarged bore section 110, one or more ports 142 are provided which extend from said bore segment 110 to the exterior of the handle, to open to the atmosphere. Accordingly, even though the design of the unit 22 may be such that the enlarged end portion 110 of the bore 104 is sealed the passage 138 and the valve chamber 132 will, at all times, be in communication with the atmosphere via port 142.

Figure 6:
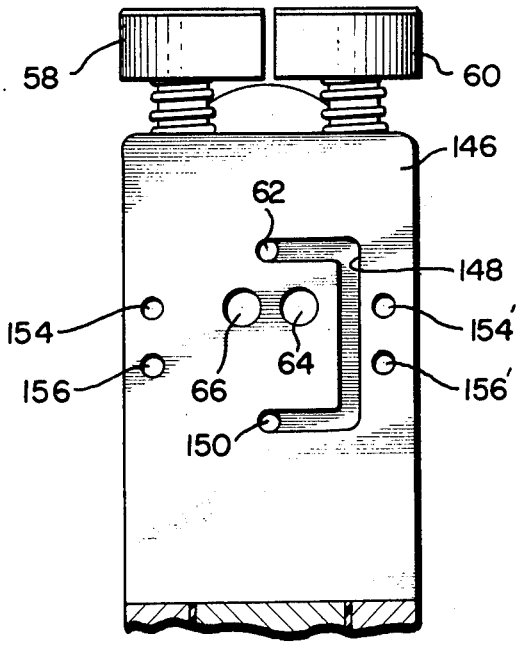
FIG. 6 is a view taken along the line 6—6 in FIG. 1 in a direction opposite to that of FIG. 5.

The paths for supply of the pressurized medium to the various valve chambers will now be considered. With reference to the prior description of the operation of the invention, as presented in the introductory portion of the specification, it should be noted that the valve chamber 132 serves to effect the necessary venting of the respective diaphragms, while the valve chambers 130–134 operate to receive and direct the flow of the pressurized medium to said diaphragms. Passageway 62 in handle 52 carries the pressurized medium from the source 24 and is centrally disposed with respect to said handle 52 and passes intermediate the valve assemblies 58 and 60, as can be seen in FIG. 4. A transverse passage 144 is formed in the handle 52 and intersects the passageway 62 and opens into the valve bore 102 in the area of the valve chamber 130. It is important to an understanding of the supply of the pressurized medium to the other valve chamber 134 to keep in mind that the passage 62 extends past the transverse passage 144 and as can be seen in FIG. 6 opens to the end face 146 of the handle 52. With continued reference to FIG. 6, a U-shaped channel 148 is formed in said end face 146 and serves to connect the passageway 62 with a second axially extending passage or bore 150. The bore 150 extends from the end face 146 back into the handle and can be seen in dotted line in FIG. 1. The passage or bore 150 intersects with a second transverse bore 152, FIG. 4, and for purposes of illustration and understanding, a projection of this intersection is illustrated in dotted outline in FIG. 4. Transverse bore 152 opens through the wall of the valve bore 102 below the passage 144, and communicates with the valve chamber 134.

Accordingly, the pressurized medium can enter the unit 22 via the passageway 62 and will be directed to the valve chambers 130, or 130', by means of the transverse bore 144 which intersects passage 62. The pressurized medium will continue to flow along the passage 62 past the transverse bore 144 and will enter the channel 148 in the end face 146. The channel 148, which can be best viewed in FIG. 6, will be covered by the gasket 100, and accordingly, the pressurized medium will flow along the channel 148 and will enter the passage 150. From passage 150, said medium will be directed to the valve chamber 134, or 134' by the transverse bore 152.

Figure 5:
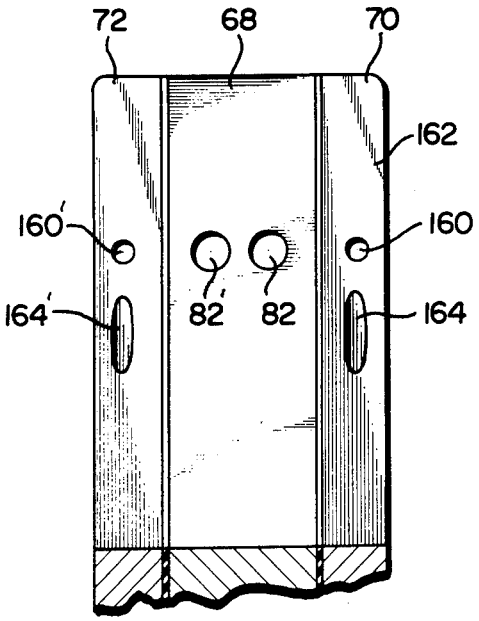
FIG. 5 is a partial sectional view taken along the line 5—5 of FIG. 1, and in the direction indicated.

Discussion will now be with regard to the path for the pressurized medium from the valve means 58 and 60 to the metering chamber diaphragm 48 and the valve chamber diaphragm 92, respectively. Discussion in this regard will initially take place with reference to FIG. 7, which is a partial sectional view taken along line 7—7 of FIG. 4, and it will continue in conjunction with FIGS. 5 and 6. With regard to said FIGS. 5 and 6, FIG. 5 is a view taken generally parallel to that of FIG. 6 at approximately the same location, but on the opposite side of the gasket 100 and in an opposite direction. Accordingly in FIG. 5 the bores or ports associated with the metering chamber 44 are on the right hand side, as viewed, while those leading to the metering chamber 44' are on the left hand side, as viewed.

Figure 7:
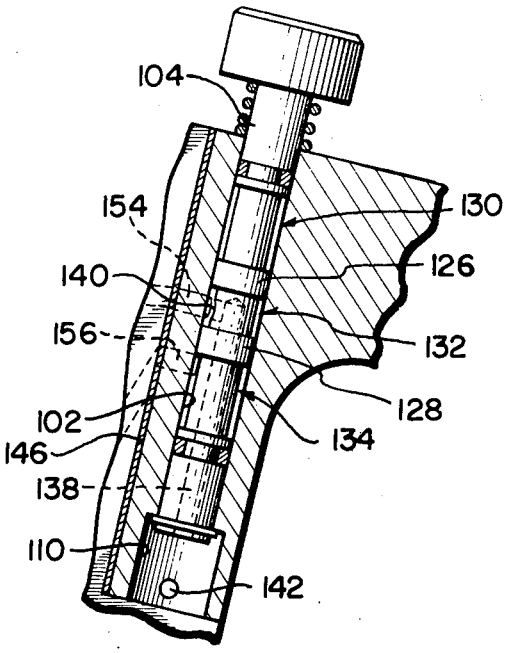
FIG. 7 is a view taken along the line 7—7 of FIG. 4, and illustrating the valve spool in the depressed condition.

As can be seen in FIG. 7, a pair of relatively parallel bores 154 and 156 extend from end face 146 and open into the valve bore 102. Similarly, bores 154' and 156' are provided for the valve means 60 and these also open to the end face 146, as can be seen in FIG. 6. The side plate or portion 70 of the metering head assembly 56 includes cavity 76 and 94 which are aligned and cooperate with the metering cavity 74 and valve cavity 92, respectively. Accordingly, since the diaphragm elements 48 and 92 are positioned intermediate the respective cavities 74–76 and 92–94, the passage means to the side of said diaphragms opposite from that which serves as wall surfaces for the chambers 44 and 96, is provided in said portion 70 in the form of a bore 160 which extends from the end surface 162 of said side plate 70 (see FIG. 5) to the cavity 76. The passage 160 can be viewed in FIG. 3 where it can also be seen that in the assembled condition, the port 154 leading from the valve bore 102 is in alignment with said passage 160, with a suitable aperture being provided in the gasket 100. Thus a direct path from the valve bore 102 to the rear or opposite side of the diaphragm 48 is provided by the port 154 and the passage 160. Correspondingly, with regard to the valve means 60, a direct path is also provided to the rear or opposite side of the diaphragm 48' by means of port 154' and passage 160'.

The path for the pressurized medium leading to the cavity 94 can best be understood with reference to FIGS. 1, 2 and 5. In this regard, a second passage 164 extends from the end face 162 of the side place 70 (FIG. 5) at an acute angle with respect to said end face, and opens through the wall surface of the cavity 94. This passage 164 is visible in dotted outline in FIGS. 1 and 2, with the intersection thereof with the cavity wall surface 94 shown in full line in FIG. 2. Thus, a path, separate and distinct from that as discussed above leading to the diaphragm 48, is provided from the valve bore 102 to the rear or opposite side of the diaphragm 92. The points at which these paths intersect the valve bore 102 are spaced axially along said bore, and correspond to the previously discussed ports 154 and 156, visible in FIG. 7.

Now that the path for the pressurized medium extending from the valve bore 102 to the opposite sides of the metering chamber diaphragm 48 and the valve chamber diaphragm 92 have been discussed, the operation of the valve means 58 and correspondingly valve means 60 will now be considered. In this regard, the pre-dispense or normal condition for the valve is illustrated in FIGS. 4 and 7. In this condition the pressurized medium will be supplied to both the valve chambers 130 and 134, while the valve chamber 132 will be vented to the atmosphere at all times by means of the port 140, axial passage 138 and the ports 142. In the normal or pre-dispensed condition the passage means 154;160 leading from the valve bore 102 to the metering chamber diaphragm 48 will be in communication with the valve chamber 132, and as such the metering chamber diaphragm 48 is vented to the atmosphere. The port 156 which cooperates with passageway 164 leading to the valve chamber diaphragm 92 will be in communication with valve chamber 134, and as such pressurized medium will be directed to the opposite side of the diaphragm 92 to in effect pressurize said diaphragm. While pressurized medium is delivered to the uppermost valve chamber 130, this chamber does not align with either port 154 or 156, and passage of the pressurized medium out of this chamber is precluded by the engagement of the land 126 with the bore wall. Should any pressurized medium leak along the interface of land 126 with the bore 102, this medium would enter the valve chamber 132 and correspondingly will be vented to the atmosphere.

Figure 8:
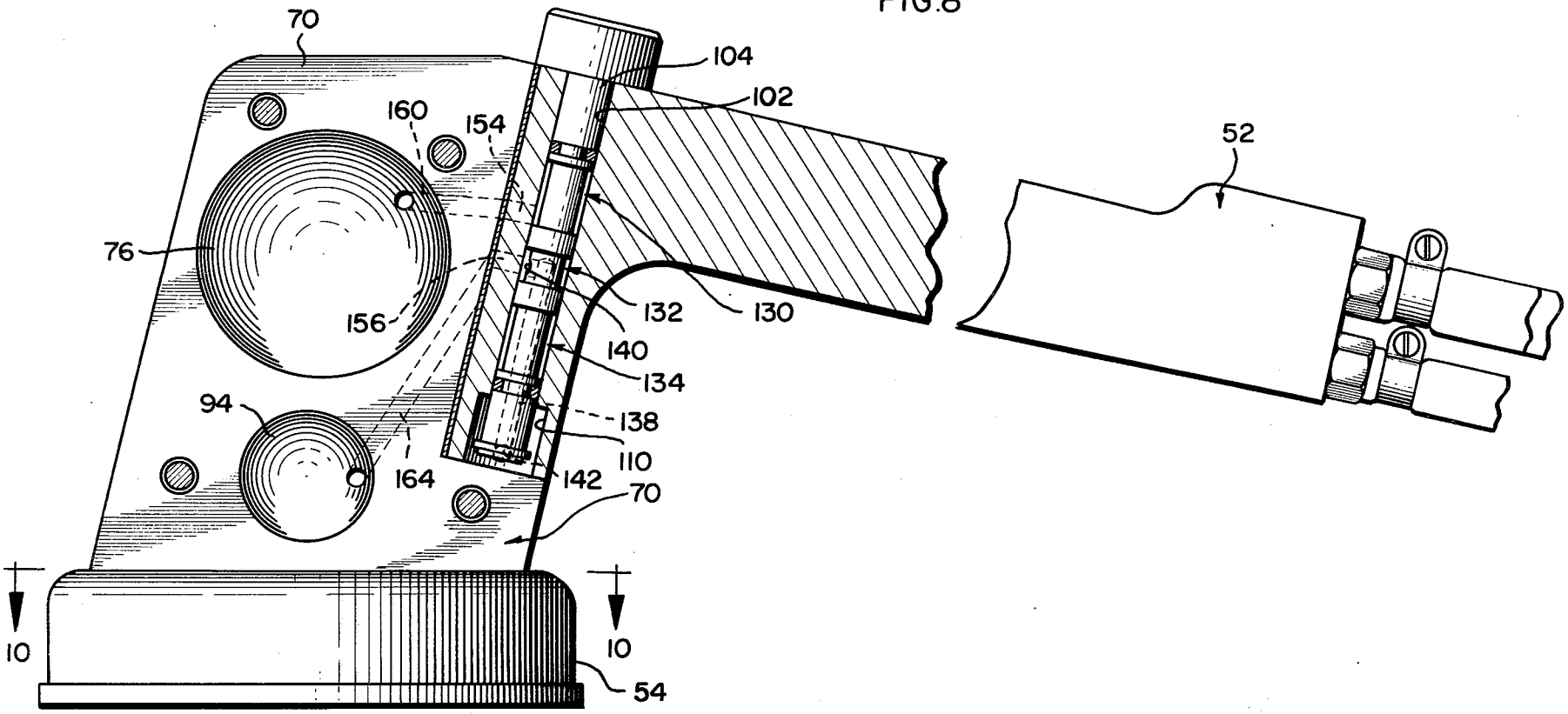
FIG. 8 is a partial sectional view of a dispensing unit illustrating the depressed condition for the control valve spindle, with the main body element removed to illustrate the construction of the side plate which overlies the surface visible in FIG. 1.

When the valve spool 104 is depressed, the valve chamber will move to the relative positions as shown in FIGS. 8 and 9. In this regard, the axial length of the chambers 130 and 134 is such that even upon depression, these chambers will remain in communication with the transverse ports 144 and 152 which supply the pressurized medium to the valve bore 102. However, upon depressing of the spool 104, the valve chamber 130 is moved into communication with the port 154, to pressurize diaphragm 48 while the valve chamber 132 will move axially into communication with the port 156 to vent diaphragm 92 to the atmosphere. Valve chamber 134 although receiving pressurized medium by way of the transverse port 152, is not placed in communication with any passageway means leading into the metering head assembly and here again if leakage occurs along the bore wall the pressurized medium will enter chamber 132 and be vented to the atmosphere.

With the previous discussion in mind, the operation of the metering unit 22 will now be considered with regard to the condiment A. It is again to be understood that the operation regarding the condiment B is essentially the same. Accordingly, in the normal or pre-dispensed condition, the valve chamber 134 will be in alignment with port 156 thereby pressurizing the diaphragm 92 to close the valve cavity 96 to liquid flow. The metering chamber diaphragm 48 is vented to the atmosphere, and accordingly, the condiment product under pressure in the supply passages 66 and 82 will pass into and completely fill the metering chamber 44 tending to expand or force the diaphragm 48 away from the wall surface of cavity 74 into engagement with the surface of cavity 76 in the side plate 70. The pressurized liquid condiment product will also enter and fill the metering chamber outlet passage 86. Further flow of the condiment product will be blocked by the valve diaphragm 92, which it will be recalled is forced into engagement with the valve cavity 88 to close valve chamber 96.

When it is desired to dispense the condiment product, the valve spool 104 is depressed to obtain a relative positioning of the valve chambers 130, 132 and 134 as shown in FIG. 8. In this condition, the valve chamber 132 will now align with the port 156, thereby venting the valve chamber diaphragm 92 to the atmosphere and releaving any force thereon due to the pressurized medium. The downward movement of the valve spool 104 will also bring the valve chamber 130 into alignment with the port 154, which it will be recalled communicates with passageway 160 leading to the opposite side of the metering chamber diaphragm 148. Accordingly, the pressurized medium will now enter the passage means defined by port 154, and passageway 160 to pressurize the metering chamber diaphragm 48. As an additional point, it should be noted that at all times, the discharge passage 98 will be at approximately atmospheric pressure, said discharge passage 98 communication with the atmosphere through the passageway means provided in the dispensing head 54.

Upon venting of the valve diaphragm 92 to the atmosphere, the force exerted on said diaphragm by the liquid condiment product under pressure in the outlet passage 86 will move the diaphragm 92 from the condition illustrated in FIG. 2 to that as illustrated in FIG. 9. More specifically, the valve chamber diaphragm 92 will be unseated from the cavity surface 88 and the weir 80, and will be forced into engagement with the wall surface of the opposed cavity 94 thereby opening the valve chamber 96 to establish a path of communication from the metering chamber 44 to the discharge passage 98. Since the product in the metering chamber 44 and the outler passage 86 is pressurized, while the discharge passage 98 is at atmospheric pressure, the condiment product will commence to flow through the valve chamber 96 into the discharge passage 98 and the dispensing head 54. The resulting flow of the condiment product will, however, last for only a very short period of time. In this regard, since the metering chamber diaphragm 48 is now pressurized, as soon as the condiment product starts to flow through the metering chamber 44 a pressure differential will be created across the diaphragm 48 which will tend to move said diaphragm toward the wall surface of the cavity 74 and weir 84. This action will occur, even though the condiment product and the pressurized medium on the opposite sides of the diaphragm 48 are at substantially the same relative pressures. As discussed above, once movement of the diaphragm occurs, further throttling of the flow of the liquid product will result, producing an even greater pressure differential to bring the diaphragm 48 rapidly into engagement with the cavity wall surface 74. Once the diaphragm 48 engages the weir 84, the flow of liquid condiment product to the metering chamber 44 is, for all practical purposes, blocked and the portion of the chamber on the outlet side of the weir 84 will be at atmospheric pressure. Thus a still further pressure differential is created causing the diaphragm to be brought into surface-to-surface engagement with the cavity 74. When this occurs, a quantity of the condiment product, approximately equal to the volume of the metering chamber 44, will be forced or expelled from said metering chamber 44 into the discharge passage 86. Thus, it can be seen that the metering chamber diaphragm 48 and the chamber 44 serve a dual or combined function, in that not only does said chamber structure serve to meter the liquid condiment product, but also functions as the inlet valve to block the flow of liquid product under pressure during dispensing.

The above discussion has been presented with the assumption that the dispensing head 54 and the discharge passageway 98 are substantially filled with condiment product prior to depression of the valve spool 104. Of course, upon initial operation several instances of depression may be required in order to achieve filling of the dispensing head. Once this is completed, however, each instance of depression of the valve spool 104 will result in the dispensing from unit 22 of a predetermined quantity of condiment product approximately equal to that being forced out of the metering chamber 44, or 44', as the case may be. As was alluded to previously, the employment of a dispensing unit with removable side plates 70 and 72 having cavities therein which serve to define to an extent the volume of the metering chambers 44 and 44' enables selection of the volume to be dispensed by use of interchangeable side plates having cavities 76 and 76' of varying dimensions.

It should also be noted, that upon depression of the valve spool 104, only the specified quantity of condiment product will be metered. Once the product in the dispensing head 54, outlet passage 86, and discharge passage 98 reach atmospheric pressure, dispensing will cease. Accordingly, upon release of the valve spool 104, the spring 108 will return the spool to the normal or pre-dispensing condition as shown in FIG. 2. When this occurs, the metering chamber diaphragms 48 and 48' will again be vented to the atmosphere, while the valve chamber diaphragms 92 and 92' will become pressurized. Since the pressurized product in the valve chambers 96 and 96' will have stablized at atmospheric pressure, the pressurization of the diaphragms 92 and 92' will rapidly force said diaphragms into engagement with the walls of cavities 88 and 88' to block the flow of liquid product through the valve chambers 96 and 96'. Correspondingly, as the metering chamber diaphragms 48 and 48' are vented to the atmosphere, the pressurized condiment product and inlet port 82 and 82' will force the valve chamber diaphragms 48 and 48' out of engagement with the cavity walls 74 and 74', thereby permitting valve chamber 44 and 44' to again become filled with condiment product, preparatory to the next dispensing cycle.

Figure 10:
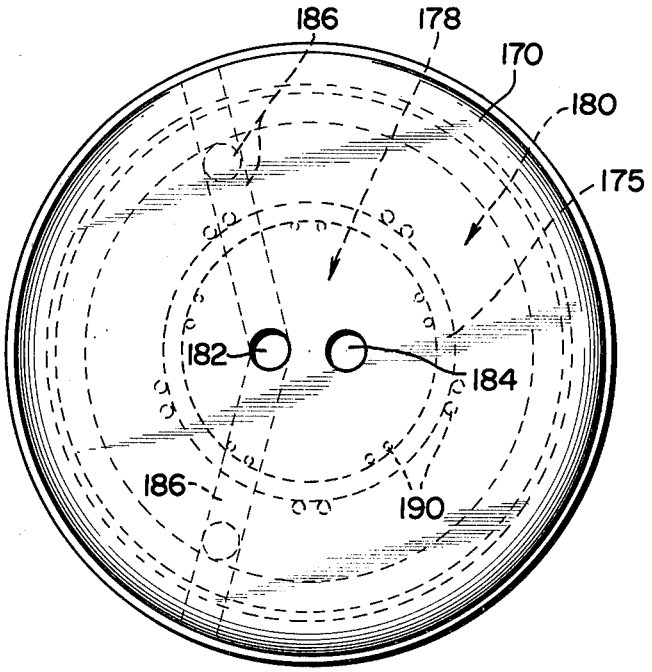
FIG. 10 is a view taken along the line 10—10 of FIG. 8, of the dispensing head.

The construction of the dispensing head 54 is best illustrated in FIGS. 2 and 10, and is similar to that employed in the embodiment of the prior application. More specifically, the dispensing head 54 includes an outer, generally cup-shaped member 170 to which is secured, a cap member 172. The cap member 172 includes a base wall 173 having thereon a pair of radially spaced, circular flanges 174 and 175. The flange 174 may be threaded for engagement with the cup-shaped member 170. Both said flanges extend axially into engagement with the base wall 176 of said cup-shaped member, to define an inner circular chamber 178 and an outer annular chamber 180. The base wall 176 of the cup-shaped member 170 includes a first port 182 which is aligned with the discharge passage 98' for condiment B, and opens directly into the central, circular chamber 178. A second port 184 is provided in said base wall 176, which port does not open through said base wall, but is intersected by one or more transverse ports 186 which lead to the outer, annular chamber 180. Accordingly, the condiment A being dispensed from the metering chamber 44, will enter the port 184 and will be directed from there to the outer chamber 180 by way of the passageway 186. The condiment B being metered by chamber 44' will enter directly into the central chamber 178. The base wall 173 of the cap member 172 is provided with a plurality of openings 190, which permit the condiment product to pass from the respective chambers 178 and 180 out of the dispensing head 54.

Accordingly, it can be seen that the respective condiment products, A and B, are metered and dispensed without co-mingling. Further, by the selective operation of the valve means 58 and 60 one, or the other, or both condiments may be applied to a food product as desired.

There has thus been disclosed in the drawings and the above description relating thereto, a preferred form of the dispensing unit and system of the present invention. Applicants themselves have contemplated numerous variations of the preferred embodiment disclosed, as undoubtedly will others skilled in the art once becoming aware of this invention. By way of example only, and without limitation, a number of considered variations are discussed immediately hereinafter.

It should be noted that while the disclosed embodiment employs a metering chamber that serves both to meter the condiment product, and also as an inlet valve means, a separate valve chamber could be employed to control the flow of pressurized product to the metering chamber. Further, while the diaphragm-type of valving illustrated provides certain operational advantages, other types of valving could be utilized to control the flow of the pressurized product without departing from the invention. Also, nitrogen gas has been selected as the pressurized medium for purposes of description as this inert gas is acceptable for use by the food industry. Accordingly, depending upon the products to be dispensed and related factors, alternate forms of pressurized mediums could be used. Further, it should be noted that the present invention is not limited to the spool-type of valving as disclosed, as alternate forms of control means for obtaining the force differential across the metering chamber diaphragm can be utilized. By way of example only, solenoids could be employed to achieve the necessary diaphragm movement either directly, or through some forced transmitting medium.

Thus, it is envisioned and indeed intended by Applicants that various changes, alterations or substitutions for the structural features of the preferred embodiment illustrated will be effected from time to time as the needs of customers dictate. As such, the present invention is not limited to the disclosed, preferred embodiment, nor is it limited to the possible alternates discussed above, but rather it is intended that the spirit and scope of the present invention be defined by the claims appended hereto.

The invention is claimed as follows:

1. A dispensing unit for use in the controlled, metered dispensing of a liquid product, said unit adapted for use in a system wherein said liquid product is supplied under pressure to said dispensing unit, said dispensing unit comprising: a main body assembly having at least one concave surface providing a metering cavity; flexible diaphragm means overlying said metering cavity forming therewith a metering chamber with one surface of said metering chamber diaphragm providing a wall of said chamber; product inlet passage means communicating with said metering chamber; and outlet passage means leading from said metering chamber; first, normally opened valve means for controlling the supply of liquid product to said metering chamber; second, normally closed valve means associated with said outlet passage means to control the flow of liquid product from said metering chamber; discharge passage means leading from said second normally closed valve means and adapted to receive liquid product therefrom for dispensing from said unit; said second, normally closed valve means including a valve cavity having a weir formed in the wall surface thereof, said outlet passage means opening to said valve cavity on one side of said weir, and said discharge passage means leading from said valve cavity on the opposite side of said weir; flexible diaphragm means overlying said valve cavity to define therewith a valve chamber and adapted to be forced into engagement with said weir to block communication between said metering chamber outlet passage means and said discharge passage means; control means operable to close said normally opened first valve means and open said normally closed second valve means, while establishing a force on the side of said metering chamber diaphragm opposite said metering cavity, to move said metering chamber diaphragm from a first position toward said cavity wall surface to a second position, thereby forcing a predetermined quantity of liquid product from said metering chamber, which will in turn cause a similar quantity of said product to be dispensed from said discharge passage means.

2. A dispensing unit according to claim 1, wherein said first valve means comprises, a weir formed in said metering cavity wall surface with said product inlet passage means opening to a first portion of said metering chamber on one side of said weir, and said outlet passage means communicating with a second portion of said cavity on the opposite side of said weir, such that upon movement of said diaphragm from said first position toward said metering cavity wall surface, said diaphragm will be brought into contact with said weir thereby to block communication between said metering cavity portions, with the liquid product in said second cavity portion being forced into said outlet passage means.

3. A dispensing unit according to claim 2, wherein said control means include separate passage means adapted for connection to a pressurized medium with one said passage means associated with the opposite side of said metering chamber diaphragm and the other associated with the opposite side of said valve chamber diaphragm, selectively operable valve means adapted to be placed in communication with a source of pressurized medium, and upon operation thereof applying said pressurized medium to one or the other of said separate passage means, while providing for the venting of the non-pressurized passage means.

4. A unit according to claim 3, wherein said control means further includes a manually operable valve member which is biased to a first normal position for establishing supply of said pressurized medium to said valve chamber diaphragm, while venting said passage means leading to said metering chamber diaphragm, with operation of said valve member venting said passage means leading to said valve chamber diaphragm while pressurizing said passage means leading to said metering chamber diaphragm, to produce movement of said metering chamber diaphragm as is required to bring said diaphragm into engagement with said weir formed in said metering chamber and to effect the forcing of liquid product from said metering chamber into said outlet passage means.

5. A dispensing unit as defined in claim 1, wherein said control means includes separate passage means leading to the opposite sides of said metering chamber and valve chamber diaphragms, said passage means adapted to receive a pressurized medium for supply to the opposite diaphragm sides for establishing a force differential across said diaphragm, said control means further including valve means for selectively applying said pressurized medium to one or the other of said passage means while venting the non-pressurized passage means.

6. A dispensing unit as defined in claim 5, wherein said body assembly includes a first body portion having said metering and valve cavities formed therein, and a second body portion attached thereto and overlying said diaphragm means, with said separate passage means for the pressurized medium being at least partically defined by said second body portion.

7. A unit as defined in claim 5, wherein said valve means includes a manually operable valve member which is biased to a first, normal position for establishing supply of said pressurized medium to the opposite side of said valve diaphragm of said second, normally closed valve means, while venting said passage means leading to the opposite side of metering chamber diaphragm, such that pressurized product is free to enter and fill said metering chamber, with movement of said valve member to a second position adapted to supply pressurized medium to the opposite side of said metering chamber diaphragm, while venting said passage means leading to the valve chamber diaphragm, such that said metering chamber diaphragm will be forced toward said second position to force liquid product out of said metering chamber, with the venting of the pressurized medium from behind said valve cavity diaphragm permitting second, normally closed valve means to open and thereby enabling pressurized product to enter said discharge passage means.

8. A dispensing unit according to claim 1, which includes a plurality of said metering chambers with separate normally closed second valve means provided for each such chamber, with independent discharge passage means leading from each said separate normally closed second valve means.

9. A dispensing unit according to claim 8, wherein separate supply passage means for each said metering chamber is provided, such that a plurality of liquid product may be dispensed from said unit.

10. A dispensing unit for use in the controlled, metered dispensing of a liquid product supplied to said unit under pressure, said unit including: a metering chamber defined by a cavity having a flexible, relatively movable diaphragm member engaged thereover to define an opposed wall surface of said chamber; first valve means providing for the supply of liquid product under pressure to said metering chamber; second valve means for controlling the flow of liquid product from said chamber to discharge passage means provided by said unit for the dispensing of said product; and control means for the selective and alternate application of a pressurized medium, said pressurized medium being employed to effect the opening and closing of said first and second valve means, with the flow thereof being controlled by a valve member, said valve member being biased to a first position wherein the side of said diaphragm opposite said side forming part of said chamber is vented and said first valve means is open while said second valve means closed, with said valve member being movable to a second position to pressurize said metering chamber diaphragm, while opening said second valve means and closing said first valve means, such that said first valve means may be opened and said second valve means closed when said opposite side of said diaphragm is vented to permit liquid product under pressure to enter and fill said metering chamber, with operation of said valve means to the second position opening said second valve means and closing said first valve means, and effecting the supply of said pressurized medium to said opposite side of said diaphragm, which will force said diaphragm toward said cavity wall surface to expel a predetermined quantity of liquid product from said metering chamber.

11. A dispensing unit for use in the controlled, metered dispensing of a liquid product, said unit adapted for use in a system wherein said liquid product is supplied under pressure to said dispensing unit, said dispensing unit comprising: a main body assembly having at least one concave surface providing a metering cavity; flexible diaphragm means overlying said metering cavity forming therewith a metering chamber with one surface of said metering chamber diaphragm providing a wall of said chamber; product inlet passage means communicating with said metering chamber through said concave surface; and outlet passage means leading from said metering chamber; first normally opened valve means associated with said product inlet passage means for controlling the supply of liquid product to said metering chamber; second, normally closed valve means associated with said outlet passage means to control the flow of liquid product from said metering chamber; discharge passage means leading from said second normally closed valve means and adapted to receive liquid product therefrom for dispensing from said unit; said first, normally open valve means being provided partially by said flexible diaphragm means which is adapted to be forced into engagement with said concave surface to block communication between said metering chamber and said inlet passage means thus closing said first normally open valve means; control means operable to open said normally closed second valve means, while establishing a force on the side of said metering chamber diaphragm opposite said metering cavity, to move said metering chamber diaphragm from a first position toward a second position in engagement with said cavity wall surface, thereby closing said first valve means and forcing a predetermined quantity of liquid product from said metering chamber, which will in turn cause a similar quantity of said product to be dispensed from said discharge passage means, said metering cavity and said diaphragm thus serving to meter the liquid product and also provide said first valve means.

12. A dispensing unit according to claim 11, wherein said control means includes a valve member for the control of the supply of a pressurized medium to the opposite side of said metering chamber diaphragm, said valve member being biased to a first position venting said opposite side of the diaphragm to the atmosphere thereby opening said first valve means, with pressurized medium being employed to effect closing of said second valve means, said valve member being movable to a second position to pressurize the opposite side of said metering chamber diaphragm and effect closing said first valve means, while opening said second valve means.

13. A dispensing unit as defined in claim 12, wherein said second valve means includes a valve cavity, said outlet passage means leading from said metering chamber to said valve cavity, and said discharge passage means leading from said valve cavity, flexible diaphragm means overlying said valve cavity to define therewith a valve chamber, and said control means including means for the supply of pressurized medium to the side of said valve chamber diaphragm means opposite that facing said valve cavity, such that upon the supply of said pressurized medium said valve chamber diaphragm will be forced into engagement with said valve cavity surface to effect closing of said second valve means.

14. A dispensing unit according to claim 13, wherein said valve cavity includes a weir formed in the wall surface thereof, and said outlet passage means opens to said cavity on one side of said weir, and said discharge passage means leads from said cavity on the opposite side of said weir.

15. A dispensing unit according to claim 11, wherein a plurality of metering chambers are provided, with separate liquid product supply and discharge passage means for each said chamber, so that a plurality of different products may be dispensed.

16. A dispensing unit according to claim 15, wherein said control means comprise separate, selectively operable means for control of each dispensing from each said metering chambers.

17. A dispensing unit according to claim 11, wherein said first valve means includes, a weir formed in said metering cavity wall surface with product inlet passage means opening to a first portion of said metering cavity on one side of said weir, and outlet passage means communicating with a second portion of said cavity on the opposite side of said weir, such that upon movement of said metering chamber diaphragm, said diaphragm will be brought into contact with said weir thereby to block communication between said metering cavity portions, with the liquid product in said second cavity portion being forced into said outlet passage means, said metering cavity and metering chamber diaphragm thus serving both to meter the liquid product and also provide said first valve means.

18. A dispensing unit according to claim 11 wherein said second valve means is provided by a valve cavity and diaphragm means overlying said cavity to define a valve chamber, with said control means including additional passage means leading to said valve cavity and provided for the supply of pressurized medium to the opposite side of said valve chamber diaphragm to produce closing of said second valve means.

19. A dispensing system for use in the controlled, metered dispensing of a liquid product, said system comprising: a container for the supply of liquid product under pressure adapted to be operably connected with a source of pressure to attain pressurized storage of said product at a selected pressure level; a dispensing unit operably connected to said container for the selective dispensing of a predetermined, metered quantity of liquid product upon operation thereof, said dispensing unit comprising: a main body assembly having at least one concave surface providing a metering cavity, flexible diaphragm means overlying said metering cavity forming therewith a metering chamber with one surface of said metering chamber diaphragm providing a wall of said chamber, product inlet passage means communicating with said metering chamber through said concave surface, and outlet passage means leading from said metering chamber, first, normally opened valve means associated with said product inlet passage means for controlling the supply of liquid product to said metering chamber; second, normally closed valve means associated with said outlet passage means to control the flow of liquid product from said metering chamber, discharge passage means leading from said second normally closed valve means and adapted to receive liquid product therefrom for dispensing from said unit; said first, normally open valve means being provided partially by said flexible diaphragm means which is adapted to be forced into engagement with said concave surface to block communication between said metering chamber and said inlet passage means thus closing said first normally open valve means; control means operable to open said normally closed second valve means, while establishing a force on the side of said metering chamber diaphragm opposite said metering cavity, to move said metering chamber diaphragm from a first position toward a second position in engagement with said cavity wall surface, thereby closing said first valve means and forcing a predetermined quantity of liquid product from said metering, which will in turn cause a similar quantity of said product to be dispensed from said discharge passage means, said metering cavity and said diaphragm thus serving to meter the liquid product and also provide said first valve means.

20. A system according to claim 19 wherein said second valve means is provided by a valve cavity and second, relatively movable diaphragm means overlying said valve cavity, and said control means includes means for selectively pressurizing said second, valve cavity diaphragm, such that when pressurized said diaphragm will be in engagement with said cavity wall surface to block the flow of liquid product through said cavity.

21. A system according to claim 19, further including a source of pressurized medium, which source is employed to store and supply said liquid product under pressure, and also provide the pressurized medium for operation of said metering chamber diaphragm.

22. A system according to claim 21 further including pressure regulating means for adjusting the level of said pressurized medium supplied directly to said unit in relation to that supplied for the storage of said liquid product under pressure.

23. A system according to claim 19, wherein there is provided a plurality of said metering chambers and a plurality of said containers for supplying liquid product under pressure to said dispensing unit, and said unit including separate valve and passage means for the dispensing of said liquid products from said containers without the co-mingling thereof.

* * * * *